US005380627A

United States Patent [19]

Grimsey

[11] Patent Number: 5,380,627

[45] Date of Patent: Jan. 10, 1995

[54] METHOD OF PROCESSING A PHOTOGRAPHIC SILVER HALIDE COLOR MATERIAL UTILIZING A PROCESSING TANK HAVING A BARRIER

[75] Inventor: Andrew D. Grimsey, Luton, Great Britain

[73] Assignee: Eastman Kodak Company, Rochester, N.Y.

[21] Appl. No.: 50,099

[22] PCT Filed: Nov. 11, 1991

[86] PCT No.: PCT/EP91/02129

§ 371 Date: May 7, 1993

§ 102(e) Date: May 7, 1993

[87] PCT Pub. No.: WO92/09009

PCT Pub. Date: May 29, 1992

[30] Foreign Application Priority Data

Nov. 14, 1990 [GB] United Kingdom ..... 9024783

[51] Int. Cl.[6] ..... G03C 5/18; G03C 5/26; G03C 7/00; G03C 7/46

[52] U.S. Cl. ..... 430/399; 430/398; 430/373; 430/380; 430/943; 354/322; 354/323; 354/324; 354/331; 354/332

[58] Field of Search ..... 354/322, 323, 324, 331, 354/332, 336; 430/398, 399, 373, 380, 943

[56] References Cited

U.S. PATENT DOCUMENTS

| | | | |
|---|---|---|---|
| 4,719,173 | 1/1988 | Hahm | 430/398 |
| 4,980,714 | 12/1990 | Nakamura et al. | 354/322 |
| 5,021,326 | 6/1991 | Meckl et al. . | |
| 5,043,756 | 8/1991 | Takabayashi et al. | 354/324 |
| 5,066,570 | 11/1991 | Nakamura | 354/322 |
| 5,260,184 | 11/1993 | Marsden et al. | 430/398 |

FOREIGN PATENT DOCUMENTS

| | | | |
|---|---|---|---|
| 29722 | 6/1981 | European Pat. Off. . | |
| 105842 | 4/1984 | European Pat. Off. . | |
| 62-139548 | 6/1987 | Japan . | |
| 4-107452 | 4/1992 | Japan | 354/323 |
| 1268126 | 3/1972 | United Kingdom . | |
| 1313796 | 4/1973 | United Kingdom . | |
| 1399481 | 7/1975 | United Kingdom . | |
| 1403418 | 8/1975 | United Kingdom . | |
| 1560572 | 2/1980 | United Kingdom . | |
| 87/02150 | 4/1987 | WIPO . | |
| 90/13061 | 11/1990 | WIPO . | |
| 91/12567 | 8/1991 | WIPO . | |
| 91/15806 | 10/1991 | WIPO . | |

OTHER PUBLICATIONS

Abstract of Japanese Patent Specification JPA 55/117144 assigned to Konishiroku Photo KK, dated Sep. 9, 1980.

*Primary Examiner*—Charles L. Bowers, Jr.
*Assistant Examiner*—J. Pasterczyk
*Attorney, Agent, or Firm*—Sarah Meeks Roberts

[57] ABSTRACT

A method of processing an imagewise exposed photographic silver halide material in a system which includes circulation and replenishment of the processing solution employed in at least one processing step characterized in that said processing step takes place in a processing tank divided into at least two parts separated by a barrier which reduces the mixing of the solutions in the neighboring parts and in that each part is separately recirculated and replenished to maintain a different concentration of a processing bath component in the first or earlier part than the second or later part.

9 Claims, 1 Drawing Sheet

(PRIOR ART)
FIG. 1
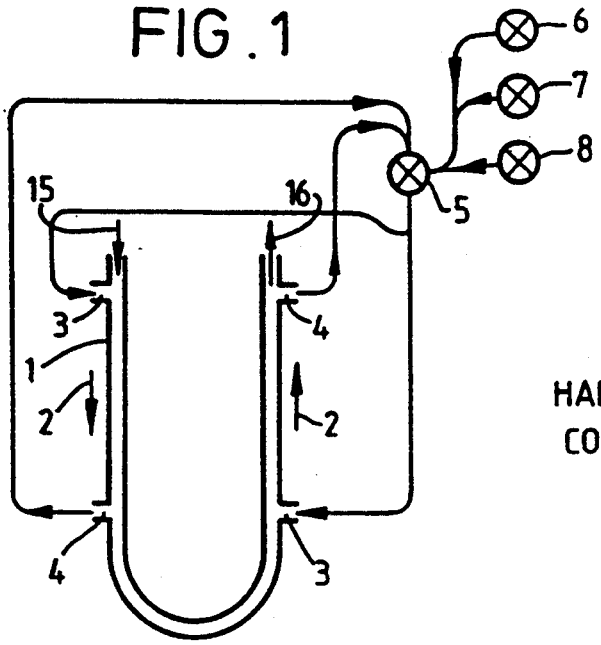
(PRIOR ART)
FIG. 2
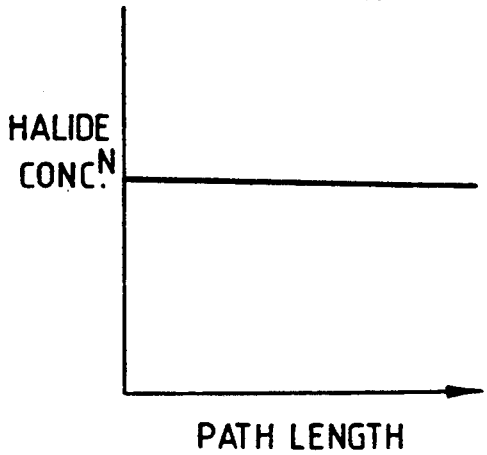
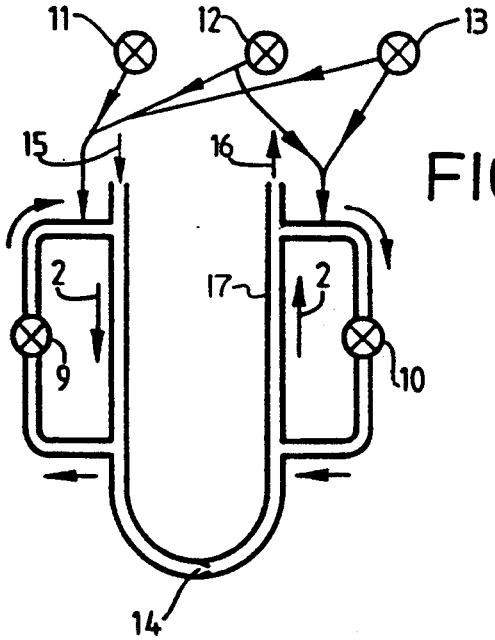
FIG. 3
FIG. 4
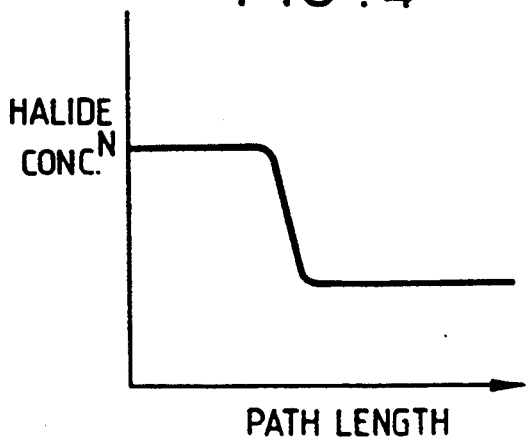

METHOD OF PROCESSING A PHOTOGRAPHIC SILVER HALIDE COLOR MATERIAL UTILIZING A PROCESSING TANK HAVING A BARRIER

This invention relates to a method of processing a photographic silver halide material and particularly to the dye image-forming step.

Photographic silver halide colour materials comprise at least one silver halide emulsion layer and, associated therewith, a dye-forming colour coupler. On development with a colour developing agent, the oxidised colour developing agent couples with the coupler to form image dye.

Many processing machines provide replenishment of the processing solutions to replace active ingredients which have been consumed in the process or that have deteriorated due to reactions with, for example, oxygen in the air.

When colour development takes place silver halide in the photographic material is reduced releasing halide ions into the solution. These have a inhibiting effect on the dye image-forming process and most colour developers are designed to operate with a particular level of halide in the solution. This is particularly true in a redox amplification system using hydrogen peroxide. It is usual to maintain a constant level of halide ion to ensure uniform imageforming performance.

In the abstract of Japanese patent application 55/117144 a system is proposed for reducing the concentration of halide ions as development progresses by a system of multiple tanks (or troughs) separated by halide ion removing baths. It is said to utilise developing agents with high efficiency, provide rapid processing and reduce staining and fogging. Such a system is, however, over complicated having 2–5 developing troughs and 1–4 halide-removing baths and would be very difficult to implement, especially if it was a replenished system.

The present invention provides a practical method of maintaining controlled concentration profiles for a processing bath component, for example halide ions, in a single processing tank.

According to the present invention there is provided a method of processing an imagewise exposed photographic silver halide material in a system in which at least one processing step comprises transporting the material through a processing tank through which the processing solution (which is replenished when necessary) is recirculated characterized in that said processing step takes place in a single processing tank divided into at least two parts separated by a barrier through which the material passes but which reduces the mixing of the solutions in the neighbouring parts and in that each part is separately recirculated and replenished to maintain a different concentration of a processing bath component in the first or earlier part than the second or later part.

BRIEF DESCRIPTION OF THE DRAWINGS

FIG. 1 is a schematic of a prior art replenishment system for an RX developer/amplifier tank.

FIG. 2 is a plot of the uniform halide ion concentration throughout the tank of FIG. 1.

FIG. 3 is a schematic of a replenishment system according to the present invention.

FIG. 4 is a plot of the non-uniform halide ion concentration throughout the tank of FIG. 3.

The present invention may, in particular, be applied to the control of halide ion concentration in processing baths.

Although the remaining description is directed to the redox amplification processing of silver chloride colour papers it is specifically recognised that the present invention also has application to more conventional processes, for example conventional colour development. In such a case the developer-amplifier described hereinafter would be replaced by a colour developer.

The present method is particularly suitable for a redox amplification method of dye image formation. Redox amplification processes have been described, for example in British Specification Nos. 1,268,126, 1,399,481, 1,403,418 and 2,560,572. In such processes colour materials are developed to produce a silver image (which may contain only small amounts of silver) and then treated with a redox amplifying solution (or developer-amplifier) to form a dye image. The redox amplifying solution contains a reducing agent, for example a colour developing agent, and an oxidising agent which will oxidise the colour developing agent in the presence of the silver image which acts as a catalyst. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide, cobalt (III) complexes including cobalt hexammine complexes, and periodates. Mixtures of such compounds can also be used. The method of the invention and the apparatus described herein are particularly useful for performing a developer-amplifier step in a redox amplification process. Such processing baths may be formulated as described in the art. This step may optionally be followed by stop bath, bleach and fix steps using conventional processing machinery. A particular application of this technology is in the processing of silver chloride colour paper, especially such paper with low silver levels, for example wherein in the total silver halide coating weight is less than 300 mg/m$^2$, preferably less than 200 mg/m$^2$ and particularly less than 150 mg/m$^2$ (as silver). The preferred photographic colour paper materials are based on emulsions which comprise at least 80%, preferably at least 90% silver chloride and especially substantially pure silver chloride.

While colour image formation is occuring halide ions are released by the silver halide material. It may be necessary to replenish halide ions in the first part of the tank. It will, however, be unnecessary to add additional halide ions to the second half of the tank and, indeed, there are advantages to be gained from not so doing. In the case of redox amplification baths and due to their inherent instability, they are replenished much more often than a conventional colour developing bath. Hence at times when no processing occurs, no halide is being released into the bath thus producing a lower halide concentration than is necessary to maintain the processing conditions within the correct design limits. In such a situation it will be necessary to add halide ions to the replenisher for the first half of the tank to maintain the desired halide ion concentration profile throughout the whole tank. Halide addition to the first half of the tank will usually also be required at start up after, say, being inactive overnight.

Replenishment of other consumable processing solution components may also be needed under idling and start up conditions.

Since the amplifying solution contains both an oxidising agent and a reducing agent it is inherently unstable. One method of dealing with this problem is to use a discrete amount of processing solution for each unit of photographic material and discard it when the material has been processed. This is the so-called "one shot" approach which generally leads to the maximum chemical usage and effluent generation.

When such an unstable processing solution is used in a processing machine, the usual replenishers used for conventional colour developers will not be applicable and special replenishment systems need to be devised. Such a system is described in our copending British application number 9003282.2.

In such an environment it is advantageous to use a processing tank of minimum volume so as to reduce both replenishment requirements and effluent volume.

The processing tank is divided into its parts by such means as pairs of rollers, squeegee rollers or wiper blades. Such dividing means will be arranged so as to separate the solution in the first and second parts as completely as possible. FIG. 3 of the drawings, for example, shows a pair of suitably mounted wiper blades. Total or complete separation of each part is not necessary.

The present invention can maintain a halide ion concentration profile that is high in the first part of the tank and lower thereafter. Such a profile allows the image formation in the later part(s) of the tank to proceed uninhibited by the presence of halide ions.

In the accompanying drawings FIG. 1 shows a replenishment system (as generally described in copending PCT Application EP91/00266) for an RX developer/amplifier providing uniform halide ion concentration throughout the tank which is plotted in FIG. 2. FIG. 3 shows a replenishment system according to the present invention with a non-uniform halide profile which is plotted in FIG. 4.

In FIG. 1 there is shown a U-shaped developing tank (1) of small volume having an inside width of about 2 mm. The material to be processed enters and leaves as indicated by arrows 15 and 16. Inlets (3) and outlets (4) are provided for the recirculation and replenishment of the processing solution in the direction shown by the arrows (2). A recirculation pump (5) is provided and replenisher pumps (6), (7) & (8) provide replenisher for the halide, amplifier and developer components of the solution to the recirculating solution stream. The halide concentration profile thoughout the path length of the tank is uniform as shown in the plot of FIG. 2.

In FIG. 3 there is shown a system similar to that of FIG. 1 except that it is adapted to carry out the method of the present invention. In this case a separate recirculation system is provided for each limb of the U-shaped tank, (17) each having its own recirculation pump (9) & (10) while the tank is provided with a barrier formed by a pair of wiper blades (14). The halide replenisher delivered by pump (11) is feedable only to the solution stream circulated by pump (9) while the amplifier and developer replenishers are feedable from pumps (12) and (13) to the streams circulated by both pumps (9) and (10). In this arrangement there is a sharp difference in the halide concentration vs. the path length of the tank as shown by the plot of FIG. 4.

The replenishment streams to the first and second parts of the tank may additionally be controlled by means, e.g. valves or pumps, (not shown) controlling entry of the solutions into the tank recirculation systems.

I claim:

1. A method of processing an imagewise exposed photographic silver halide material, comprising:

transporting the material through a processing tank containing redox amplification processing solution comprising a color developing agent and an oxidising agent, wherein said processing tank is divided into at least two parts separated by a barrier which allows the material to pass but which reduces mixing of solution components between said at least two parts; and recirculating and replenishing the solution in each of said at least two parts separately to maintain a different concentration of halide ions in said at least two parts of said processing tank.

2. A method as claimed in claim 1, wherein said oxidising agent is a peroxide oxidising agent.

3. A method as claimed in claim 1, wherein the halide ion concentration is maintained at a higher level in the part of said processing tank where the material is first transported.

4. A method according to claim 2, wherein said peroxide oxidising agent is hydrogen peroxide.

5. A method as claimed in claim 1, wherein said barrier comprises rollers, squeegee rollers or wiper blades.

6. A method as claimed in claim 1, wherein said photographic silver halide material comprises at least 80% silver chloride.

7. A method as claimed in claim 1, wherein said photographic silver halide material comprises substantially pure silver chloride.

8. A method as claimed in claim 1, wherein said photographic silver halide material comprises a total silver halide coating weight of less than 150 $mg/m^2$.

9. A method as claimed in claim 1, wherein said replenishing is carried out by separately adding color developing agent, oxidising agent and halide ion replenishers to one or more of said at least two parts.

* * * * *